US007446468B2

(12) United States Patent
Hong et al.

(10) Patent No.: US 7,446,468 B2
(45) Date of Patent: Nov. 4, 2008

(54) ELECTRON EMISSION DISPLAY

(75) Inventors: Su-Bong Hong, Yongin-si (KR); Sang-Jo Lee, Yongin-si (KR); Sang-Ho Jeon, Yongin-si (KR); Jin-Hui Cho, Yongin-si (KR); Sang-Hyuck Ahn, Yongin-si (KR); Byung-Gil Jea, Yongin-si (KR); Dong-Su Chang, Yongin-si (KR); Cheol-Hyeon Chang, Yongin-si (KR); Jae-Hoon Lee, Yongin-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 11/595,547

(22) Filed: Nov. 10, 2006

(65) Prior Publication Data

US 2007/0182311 A1 Aug. 9, 2007

(30) Foreign Application Priority Data

Nov. 14, 2005 (KR) ..... 10-2005-0108446

(51) Int. Cl.
*H01J 29/86* (2006.01)

(52) U.S. Cl. ..... 313/495

(58) Field of Classification Search ..... 313/44, 313/45, 495–497, 479
See application file for complete search history.

(56) References Cited

U.S. PATENT DOCUMENTS 5,777,432 A * 7/1998 Xie ..... 313/495
5,869,919 A * 2/1999 Sato et al. ..... 313/17
2005/0082964 A1* 4/2005 Konishi ..... 313/497

FOREIGN PATENT DOCUMENTS

JP 08138578 A * 5/1996

* cited by examiner

*Primary Examiner*—Nimeshkumar Patel
*Assistant Examiner*—Christopher M Raabe
(74) *Attorney, Agent, or Firm*—Christie, Parker & Hale, LLP

(57) ABSTRACT

An electron emission display includes a first substrate and a second substrate facing each other, a side member formed along the edges of the first substrate and the second substrate to form a vacuum envelope together with the first substrate and the second substrate, an electron emission unit provided on the first substrate, a light emission unit provided on the second substrate to emit visible light when impacted by electrons from the electron emission unit, and a thermal conduction member connecting the first substrate and the second substrate.

19 Claims, 9 Drawing Sheets

ELECTRON EMISSION DISPLAY

CROSS-REFERENCE TO RELATED APPLICATION

This application claims priority to and the benefit of Korean Patent Application No. 10-2005-0108446, filed on Nov. 14, 2005, in the Korean Intellectual Property Office, the entire content of which is incorporated herein by reference.

BACKGROUND OF THE INVENTION

1. Field of the Invention

The present invention relates to an electron emission display, and in particular, to a structure that transfers heat between a first substrate and a second substrate forming a vacuum envelope.

2. Description of Related Art

In general, electron emission elements can be classified into a first type using a hot cathode as an electron emission source, and a second type using a cold cathode as the electron emission source.

The second type of electron emission elements includes a field emission array (FEA) type, a surface-conduction emission (SCE) type, a metal-insulator-metal (MIM) type, and a metal-insulator-semiconductor (MIS) type.

An electron emission display includes electron emission elements arrayed on a first substrate and a light emission unit, including phosphor layers and an anode electrode, arrayed on a second substrate to thereby perform a light emission or image display (which may be predetermined).

During operation, the electron emission display radiates heat from the electron emission elements and the light emission unit. The electron emission elements radiate heat mainly due to emission from the electron emission regions, and the light emission unit radiates heat due to a high voltage continuously applied to the anode electrode and due to excitation of the phosphor layers. The heat radiated from the electron emission elements and the light emission unit is directly transferred to the first substrate and the second substrate, respectively.

Here, the amount of the heat radiation from the electron emission elements and the amount of the heat radiation from the light emission unit may be different, and therefore a difference in temperature between the first substrate and the second substrate is generated. In general, the temperature of the first substrate on which the electron emission elements are formed is higher than the temperature of the second substrate on which the light emission unit is formed.

Spacers arranged between the first substrate and the second substrate have a gradient in temperature along their height due to the difference in temperature between the first substrate and the second substrate. The gradient in temperature may cause the electric conductivity of the spacers to vary, thus causing scanning distortion of the electron beam.

In the case that electric conductivity of the spacers varies along the height of the spacers, distribution of the equipotential line around the spacers is deformed. Accordingly, when the electron beam proceeding from the electron emission elements to the light emission unit passes around the spacers, the electron beam deviates from its original trajectory, follows a distorted trajectory, and thereby fails to arrive at the target phosphor layers.

Therefore, with the conventional electron emission display, the quality of a realized image is decreased due to abnormal light emission of the phosphor layers.

SUMMARY OF THE INVENTION

An aspect of the present invention provides an electron emission display that can reduce a difference in temperature between the first substrate and the second substrate, thereby reducing distortion of the electron beam.

The electron emission display according to an embodiment of the present invention includes a first substrate, a second substrate facing the first substrate, a side member formed along an edge of the first substrate and an edge of the second substrate to form a vacuum envelope together with the first substrate and the second substrate, an electron emission unit provided at the first substrate, a light emission unit provided at the second substrate, and a thermal conduction member connecting the first substrate and the second substrate.

The thermal conduction member may be adhered to the side member.

The side member may have an inner side surface within the vacuum envelope and an outer side surface external to the vacuum envelope, and the thermal conduction member may be formed on at least one of the inner side surface or the outer side surface of the side member.

The thermal conduction member may be formed along a periphery of the side member.

The first substrate may have a first surface facing the second substrate and a second surface facing away from the second substrate, and the second substrate may have a first surface facing the first substrate and a second surface facing away from the first substrate. The thermal conduction member may include a central portion contacting the side member, a first extension portion extending from the central portion and contacting the first surface of the first substrate, and a second extension portion extending from the central portion and contacting the first surface of the second substrate. The first extension portion may also contact the second surface of the first substrate, and the second extension portion may also contact the second surface of the second substrate.

The thermal conduction member may be formed with a metal or an alloy. For example, the thermal conduction member may be formed of one of the materials selected from the group consisting of aluminum (Al), silver (Ag), copper (Cu), gold (Au), molybdenum (Mo), tungsten (W), nickel (Ni), and combinations thereof.

The thermal conduction member may include two metal layers formed external to an active area of the first substrate and the second substrate, respectively, and a post connecting the two metal layers.

The light emission unit may include an anode electrode, and at least one portion of the metal layer on the second substrate may be opened where the portion overlaps the anode electrode.

The post may include a plurality of posts arranged between the metal layers.

The post may be a continuous body formed between the metal layers.

The electron emission unit may include cathode and gate electrodes formed on the first substrate and crossing each other, an insulating layer interposed therebetween, and electron emission regions electrically connected to the cathode electrodes.

A focusing electrode may be formed over the cathode and gate electrodes.

The electron emission regions may be formed from one of the materials selected from the group consisting of carbon nanotubes, graphite, graphite nanofiber, diamond, diamond-like carbon, fullerene ($C_{60}$), silicon nanowire, and combinations thereof.

DETAILED DESCRIPTION

Figure 1:
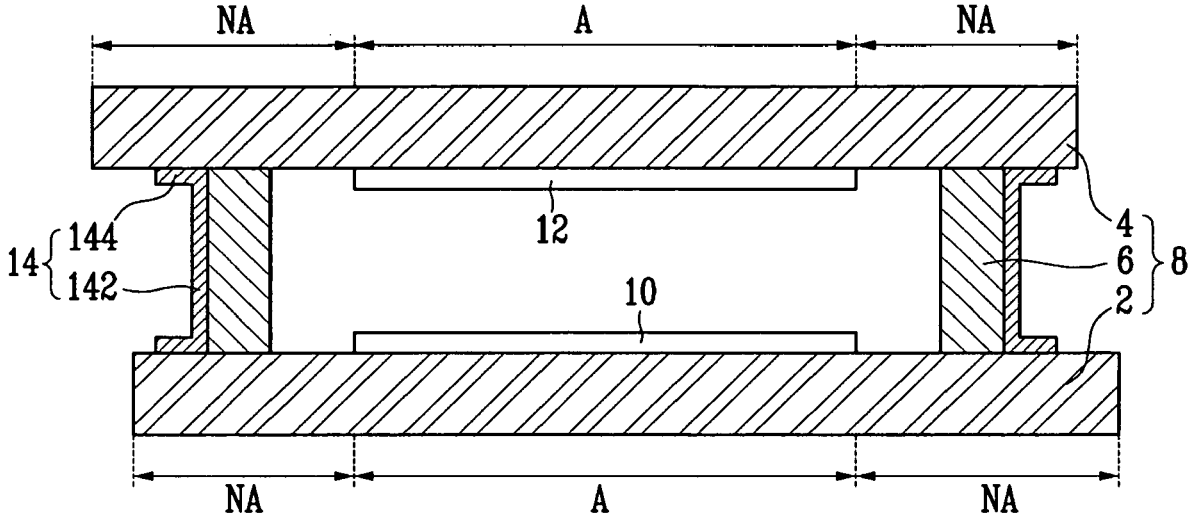
FIG. 1 is a cross-sectional view schematically showing an electron emission display according to a first embodiment of the present invention.

The accompanying drawings, together with the specification, illustrate exemplary embodiments of the present invention, and, together with the description, serve to explain the principles of the present invention. Like reference numerals designate like elements or parts.

Figure 2:
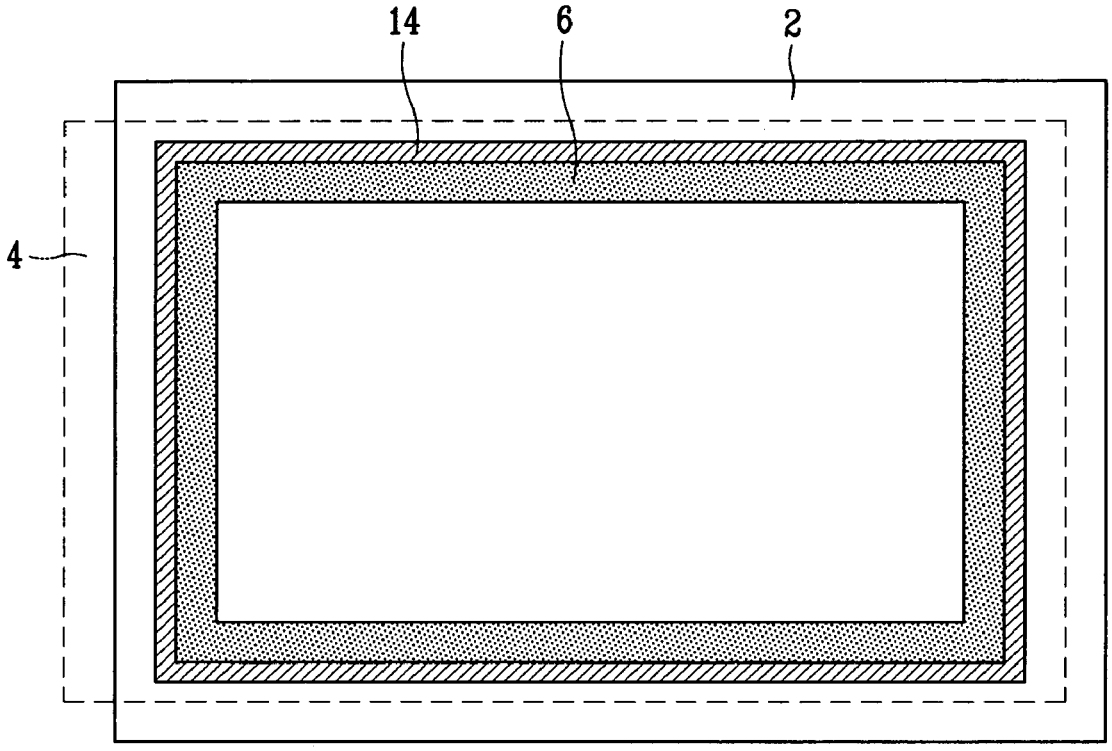
FIG. 2 is a plane view of the electron emission display shown in FIG. 1.

FIG. 1 is a cross-sectional view schematically showing an electron emission display according to a first embodiment of the present invention, and FIG. 2 is a plane view of the electron emission display shown in FIG. 1.

Referring to FIG. 1 and FIG. 2, the electron emission display according to the first embodiment of the invention includes a first substrate 2 and a second substrate 4 facing each other and arranged parallel with each other and separated from each other by a distance (which may be predetermined) therebetween.

A side member 6 is disposed at the edges of the first and second substrates 2 and 4 to form a closed inner space together with the first and second substrates 2 and 4. The closed inner space is exhausted to a vacuum degree of $10^{-6}$ Torr. Together, the first substrate 2, the second substrate 4, and the side member 6 form a vacuum envelope (or vacuum chamber) 8.

The side member 6 may be a bar made of frit glass. Alternatively, the side member 6 may include a glass frame disposed between the first and second substrates 2 and 4, and frit glass deposited between the glass frame and each of the first and second substrates 2 and 4.

Electron emission elements are arrayed on a surface of the first substrate 2 facing the second substrate 4, thereby forming an electron emission unit (or device) 10. The electron emission unit 10 is assembled with a light emission unit 12 provided on the second substrate 4, thereby forming the electron emission display.

The first and second substrates 2 and 4 are respectively demarcated into an active area A and a non-active area NA externally surrounding the active area A.

Pixels are arranged at the active area A to display the desired images. Accordingly, the electron emission unit 10 and the light emission unit 12 are located in the active area A of the first and second substrates 2 and 4, respectively.

The electron emission display according to the embodiment of the invention includes a thermal conduction member 14 connecting the first substrate 2 and the second substrate 4. The thermal conduction member 14 increases thermal diffusion between the first and second substrates 2 and 4, thereby reducing a difference in temperature between the first and second substrates 2 and 4.

As shown in FIG. 1, the thermal conduction member 14 is tightly adhered to the outer side surface of the side member 6. The thermal conduction member 14 includes a central portion 142 in contact with the side member 6 and extension portions 144 extending from the central portion 142 and contacting the inner surfaces of the first and second substrates 2 and 4. The extension portions 144 increase a contact area with the first and second substrates 2 and 4, and increase the thermal conductivity between the first and second substrates 2 and 4.

The thermal conduction member 14 may be formed with a metal such as aluminum (Al), silver (Ag), copper (Cu), gold (Au), molybdenum (Mo), tungsten (W) and nickel (Ni), or alloys thereof.

The thermal conduction member 14, as shown in FIG. 2, may be formed along a periphery of the side member 6.

Figure 3:
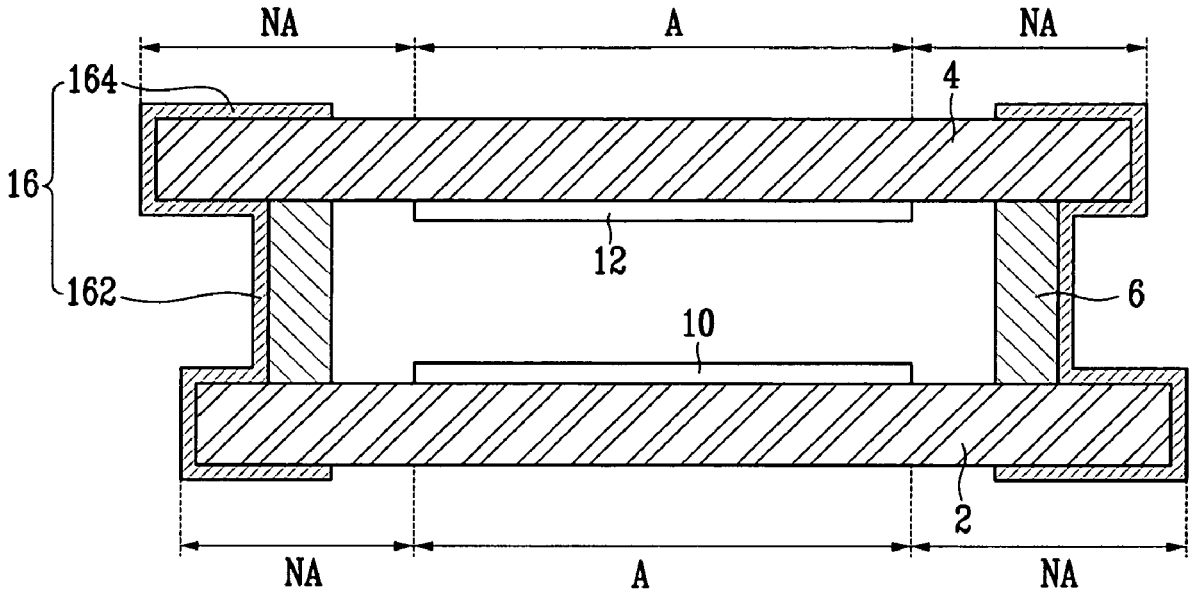
FIG. 3 is a cross-sectional view schematically showing an electron emission display according to a second embodiment of the present invention.

FIG. 3 is a cross-sectional view schematically showing an electron emission display according to a second embodiment of the present invention. FIG. 3 shows that extension portions 164 of a thermal conduction member 16 extend from a central portion 162 to the outer surface of the first and second substrates 2 and 4. Here, the extension portions 164 extend within the range of the non-active area NA and do not extend to (or invade) an area of the active area A.

Figure 4:
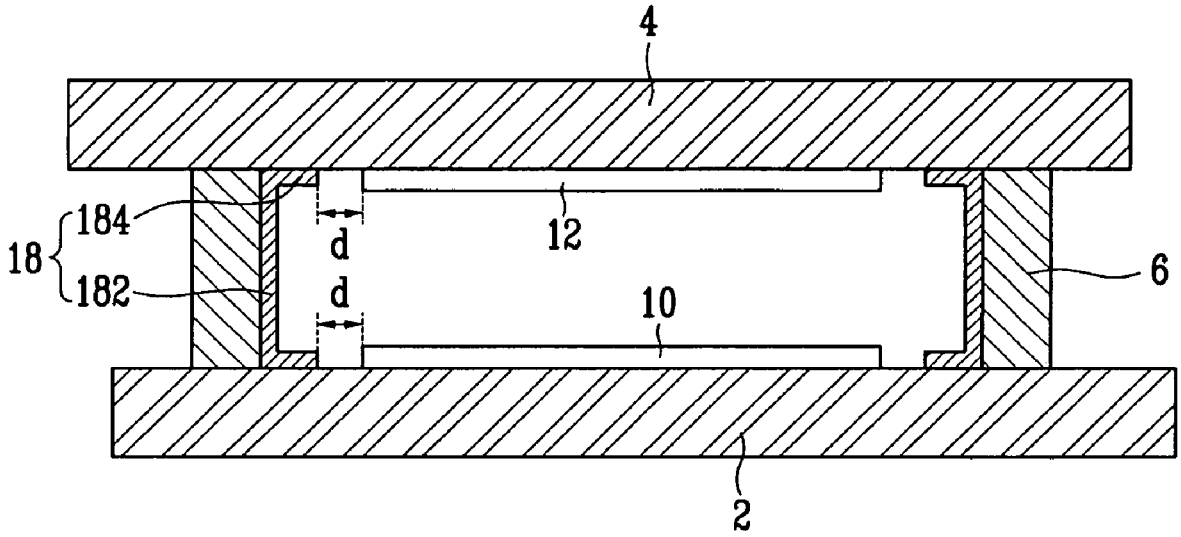
FIG. 4 is a cross-sectional view schematically showing an electron emission display according to a third embodiment of the present invention.

FIG. 4 is a cross-sectional view schematically showing an electron emission display according to a third embodiment of the present invention, and shows that a thermal conduction member 18 is tightly adhered to the inner side surface of the side member 6.

In FIG. 4, extension portions 184 of the thermal conduction member 18 extend from the central portion 182 toward the electron emission unit 10 and the light emission unit 12. The extension portions 184 are spaced apart from the electron emission unit 10 and the light emission unit 12 by a distance d (which may be predetermined) to avoid short circuits with a driving electrode of the electron emission unit 10 and an anode electrode of the light emission unit 12.

Additionally, the thermal conduction member 18 may be formed to avoid short-circuits with the terminal of the driving electrode and the terminal of the anode electrode. For example, protective layers made of an insulating material may be formed between the thermal conduction member 18 and the terminals of the driving electrode and the anode electrode.

Figure 5:
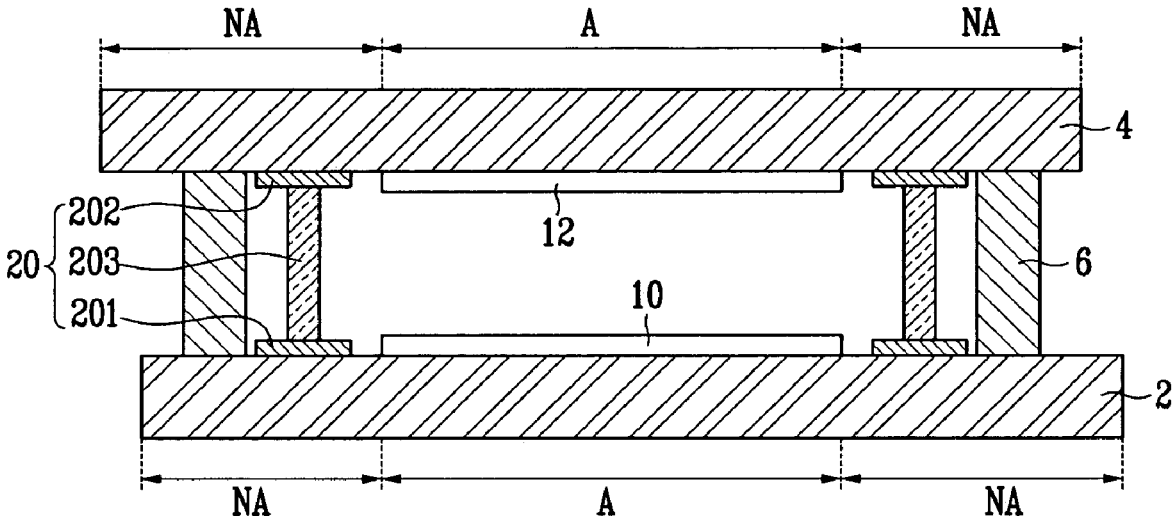
FIG. 5 is a cross-sectional view schematically showing an electron emission display according to a fourth embodiment of the present invention.
Figure 6:
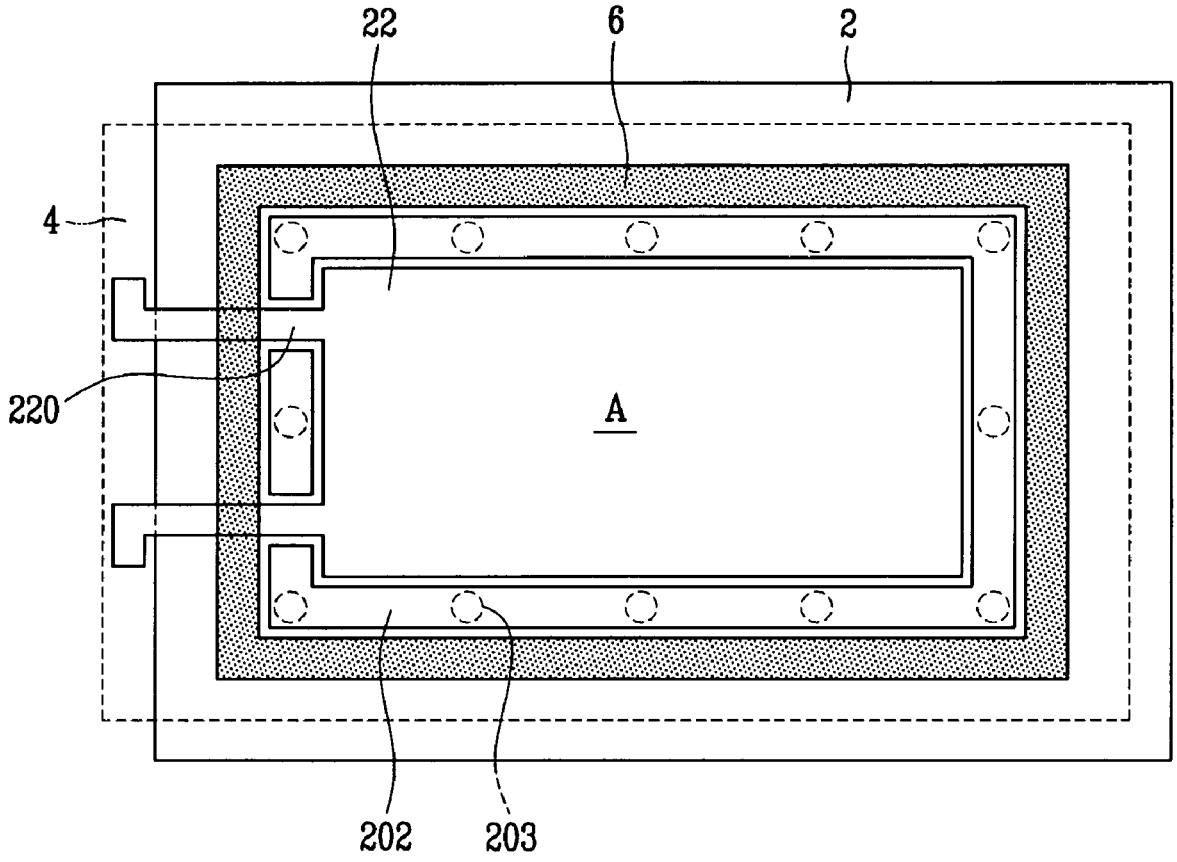
FIG. 6 is a plane view of the electron emission display shown in FIG. 5.

FIG. 5 is a cross-sectional view schematically showing an electron emission display according to a fourth embodiment of the present invention, and FIG. 6 is a plane view of the electron emission display shown in FIG. 5.

Referring to FIG. 5, a thermal conduction member 20 includes a first metal layer 201 formed in the non-active area NA of the first substrate 2, a second metal layer 202 formed in the non-active area NA of the second substrate 4, and a post 203 connecting the first metal layer 201 and the second metal layer 202. The post 203 may be formed with a material having high thermal conductivity.

As shown in FIG. 6, the second metal layer 202 surrounds the active area A of the second substrate. The second metal layer 202 may be partially removed in order to avoid short-circuits with the anode electrode 22 of the light emission unit.

That is, the second metal layer 202 may be opened at the portions that overlap with the terminal 220 of the anode electrode 22, thereby avoiding short-circuits with the terminal 220.

The post 203 performs a function of heat transfer between the first and second substrates 2 and 4 and may function as a spacer that maintains a distance (which may be predetermined) between the first and second substrates 2 and 4.

The post 203 in FIGS. 5 and 6 is formed in a cylindrical shape, and additional posts are arranged along the second metal layer 202 at intervals (which may be predetermined).

However, the shape or the arrangement of the post(s) is not limited to the above. For example, the post(s) may be formed in a wall shape and may be a continuous body formed along the second metal layer 202.

Figure 7:
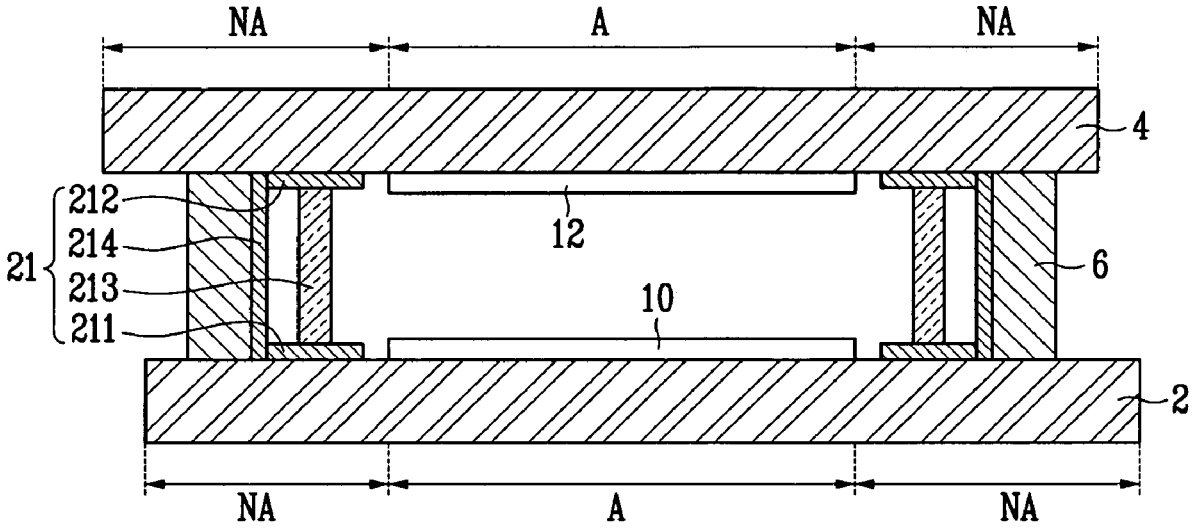
FIG. 7 is a cross-sectional view schematically showing an electron emission display according to a fifth embodiment of the present invention.

FIG. 7 is a cross-sectional view schematically showing an electron emission display according to a fifth embodiment of the present invention.

Referring to FIG. 7, a thermal conduction member 21 includes a first metal layer 211, a second metal layer 212, and a post 213. The thermal conduction member 21 further includes a connecting member 214 that connects the first metal layer 211 and the second metal layer 212, and that is tightly adhered to the side member 6.

The post 213 and the connecting member 214 are arranged in parallel with each other to connect the first metal layer 211 and the second metal layer 212. Therefore, the thermal conduction member 21 can increase the thermal conductivity between the substrates 2 and 4.

Figure 8:
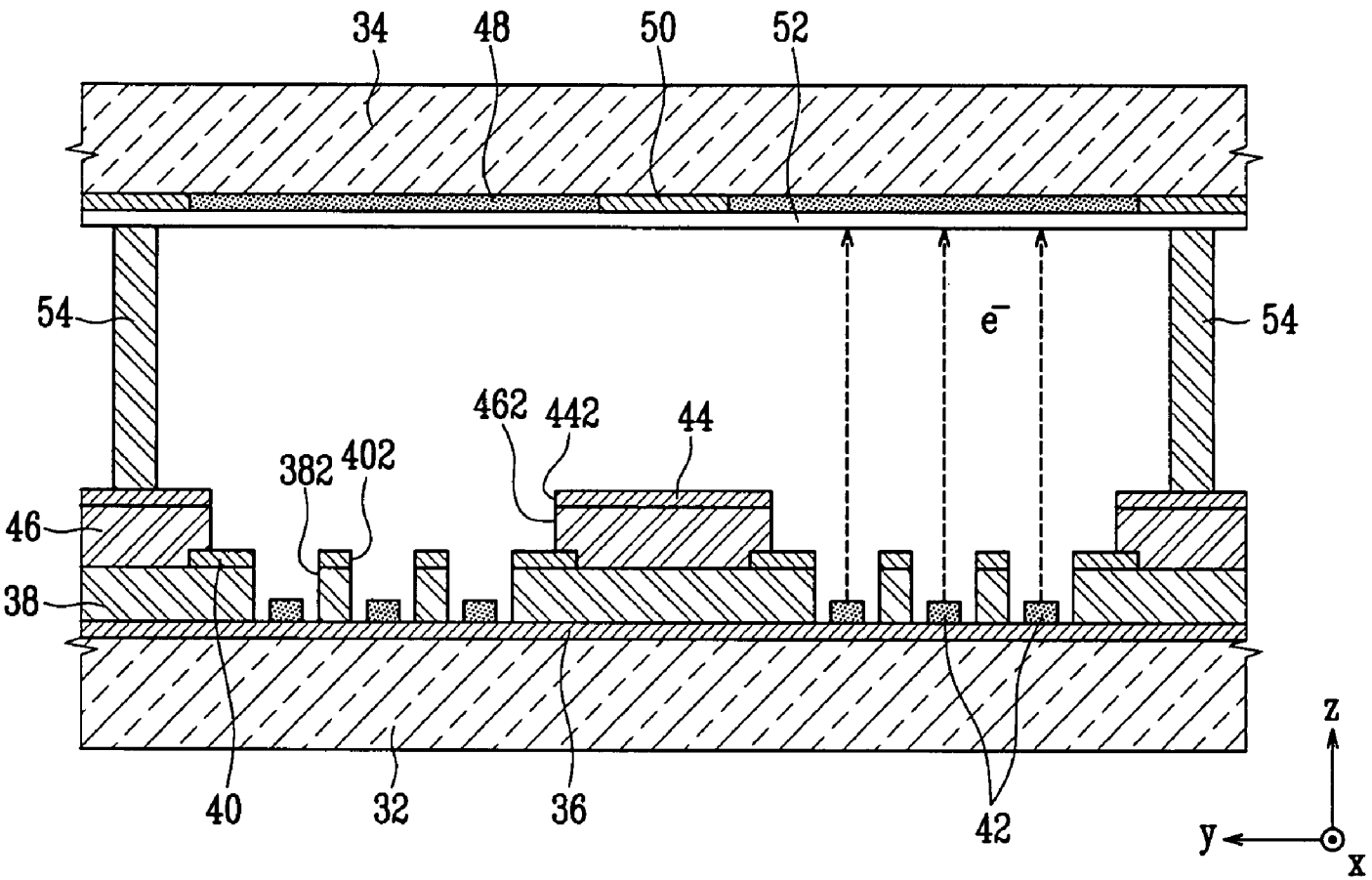
FIG. 8 is a cross-sectional view showing an electron emission display having an FEA-type electron emission element.

FIG. 8 is a cross-sectional view showing an electron emission display having an electron emission unit based on an FEA-type electron emission element.

Referring to FIG. 8, cathode electrodes 36 functioning as first driving electrodes are stripe-patterned on a first substrate 32 along a direction of the first substrate 32 (the y-axis direction of FIG. 8), and a first insulating layer 38 is formed on the first substrate 32 such that it covers the cathode electrodes 36.

Gate electrodes 40 functioning as second driving electrodes are stripe-patterned on the first insulating layer 38 along a direction perpendicular to the cathode electrodes 36 (the x-axis direction of FIG. 8).

The crossed regions of the cathode and gate electrodes 36 and 40 may define pixels, and one or more electron emission regions 42 are formed on the cathode electrodes 36 at the respective pixels.

The electron emission regions 42 may be exposed on the first substrate 32 through opening portions 382 and 402 formed at the first insulating layer 38 and the gate electrodes 40, respectively. For example, the opening portions 382 and 402 are formed corresponding to the respective electron emission regions 42.

The electron emission regions 42 are formed with a material for emitting electrons when an electric field is applied thereto under a vacuum atmosphere, such as a carbonaceous material and a nanometer-sized material. The electron emission regions 42 may be formed with carbon nanotubes, graphite, graphite nanofiber, diamond, diamond-like carbon, fullerene ($C_{60}$), silicon nanowire, or combinations thereof.

The electron emission regions 42 may be linearly arranged along the longitudinal direction of the cathode electrodes 36 or the gate electrodes 40 at the respective pixels, and may be formed in the shape of a circle. However, the shape, number per pixel, and arrangement of the electron emission regions 42 are not limited to those illustrated, and may be altered in various suitable manners.

In the above example, the gate electrodes 40 are placed over the cathode electrodes 36 with the first insulating layer 38 interposed therebetween. Alternatively, the gate electrodes may be placed under the cathode electrodes with the first insulating layer interposed therebetween. In the latter case, the electron emission regions are formed (or configured) on the first insulating layer such that they contact one surface of the cathode electrodes.

A focusing electrode 44 is formed on the gate electrodes 40 and the first insulating layer 38. A second insulating layer 46 is placed under the focusing electrode 44, thereby insulating the gate electrodes 40 and the focusing electrode 44 from each other. Opening portions 442 and 462 are formed at the second insulating layer 46 and the focusing electrode 44 for passage of electron beams.

In FIG. 8, the opening portions 442 and 462 are individually formed at the respective pixels such that the focusing electrode 44 can collectively focus the electrons emitted from each pixel. Alternatively, the opening portions may be formed corresponding to the respective opening portions 402 of the gate electrodes 40 to focus the electrons emitted from each of the electron emission regions 42 individually.

Phosphor layers 48 are formed on a surface of the second substrate 34 facing the first substrate 32 with a distance therebetween. The phosphor layers 48 may consist of red, green, and blue phosphor layers, and may be arranged corresponding to each pixel. A black layer 50 is formed on the second substrate 34 between at least two of the phosphor layers 48 for enhancing the screen contrast.

An anode electrode 52 is formed on the phosphor layers 48 and the black layer 50. The anode electrode 52 may be made of a metallic material such as aluminum. The anode electrode 52 receives a high voltage required for accelerating electron beams from the first substrate 32, and reflects visible rays radiated from the phosphor layers 48 to the first substrate 32 back toward the second substrate 34, thereby heightening the screen brightness.

Alternatively, the anode electrode may be formed of a transparent material such as indium tin oxide (ITO), instead of a metallic material. In this case, the anode electrode is placed on a surface of the phosphor and the black layers between those layers and the second substrate. In this case, a metallic layer may be additionally formed on the phosphor layers facing the first substrate. That is, the anode electrode may be formed of a double-layered structure.

A plurality of spacers 54 are provided between the first and second substrates 32 and 34 to withstand atmospheric pressure and to maintain a distance (which may be predetermined) therebetween. The spacers 54 are placed corresponding to the black layer 50 so as not to obstruct the phosphor layers 48.

Figure 9:
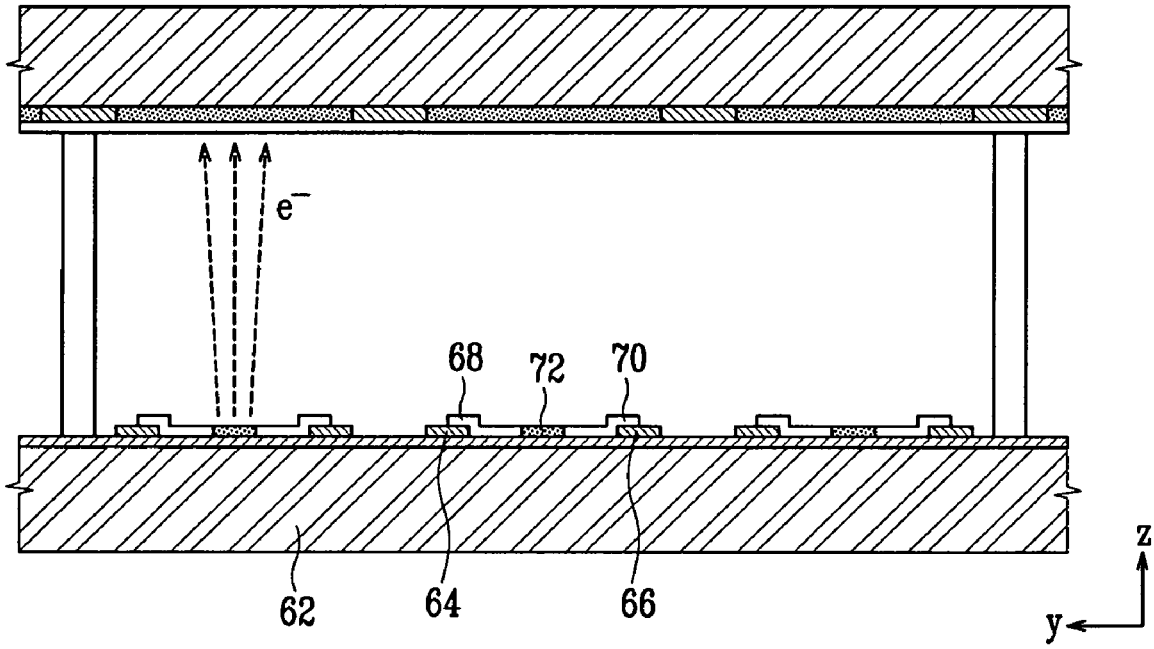
FIG. 9 is a cross-sectional view showing an electron emission display having an SCE-type electron emission element.

FIG. 9 is a cross-sectional view showing an electron emission display having an electron emission unit based on an SCE-type electron emission element.

With reference to FIG. 9, first and second electrodes 64 and 66 are arranged on the first substrate 62 parallel to each other with a distance therebetween, and first and second conductive thin films 68 and 70 are placed close to each other and partially cover the surface of the first and second electrodes 64 and 66.

Electron emission regions 72 are disposed between the first and second conductive thin films 68 and 70, and are electrically connected to the first and second electrodes 64 and 66 through the first and second conductive thin films 68 and 70.

The first and second electrodes 64 and 66 may be formed of various conductive materials. The first and second conductive thin films 68 and 70 may be formed with micro-particles of a conductive material, such as nickel, gold, platinum, and palladium.

The electron emission regions 72 may be formed with carbon or one or more carbon compounds.

The FEA-type and the SCE-type electron emission displays are illustrated; however, the electron emission display according to the present invention is not limited thereto. That is, the present invention may be applied to a vacuum fluorescent display as well as an MIM-type and/or an MIS-type electron emission display.

As described above, an electron emission display according to an embodiment of the invention has a thermal conduction member connecting the first and second substrates with each other, thereby reducing a difference in temperature between the first substrate and the second substrate and reducing the distortion of the electron beam around one or more spacers between the first and second substrates.

Accordingly, the electron emission display according to the embodiment of the invention reduces the under-emission of the phosphor layers around the spacers and improves uniformity in pixels, thereby realizing a high-definition image.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. An electron emission display comprising:

a first substrate;

a second substrate facing the first substrate;

a side member formed along an edge of the first substrate and an edge of the second substrate to form a vacuum envelope together with the first substrate and the second substrate;

an electron emission unit provided at the first substrate;

a light emission unit provided at the second substrate; and a thermal conduction member connecting the first substrate and the second substrate;

wherein the side member has an inner surface within the vacuum envelope and an outer surface external to the vacuum envelope, and wherein the thermal conduction member contacts the inner surface of the side member.

2. The electron emission display of claim 1, wherein the thermal conduction member is adhered to the side member.

3. The electron emission display of claim 2, wherein the thermal conduction member is formed along a periphery of the side member.

4. The electron emission display of claim 2, wherein the first substrate has a first surface facing the second substrate and a second surface facing away from the second substrate, and wherein the second substrate has a first surface facing the first substrate and a second surface facing away from the first substrate, and wherein the thermal conduction member comprises a central portion contacting the side member, a first extension portion extending from the central portion and contacting the first surface of the first substrate, and a second extension portion extending from the central portion and contacting the first surface of the second substrate.

5. The electron emission display of claim 4, wherein the first extension portion is spaced apart from the electron emission unit, and wherein the second extension portion is spaced apart from the light emission unit.

6. The electron emission display of claim 1, wherein the thermal conduction member is a metal or an alloy.

7. The electron emission display of claim 1, wherein the thermal conduction member comprises a material selected from the group consisting of aluminum (Al), silver (Ag), copper (Cu), gold (Au), molybdenum (Mo), tungsten (W), nickel (Ni), and combinations thereof.

8. An electron emission display comprising:

a first substrate;

a second substrate facing the first substrate;

a side member formed along an edge of the first substrate and an edge of the second substrate to form a vacuum envelope together with the first substrate and the second substrate;

an electron emission unit provided at the first substrate;

a light emission unit provided at the second substrate; and a thermal conduction member connecting the first substrate and the second substrate;

wherein the first and second substrates have an active area, and wherein the thermal conduction member comprises:

a first metal layer formed on the first substrate external to the active area of the first substrate;

a second metal layer formed on the second substrate external to the active area of the second substrate; and a thermally conducting post connecting the first and second metal layers.

9. The electron emission display of claim 8, wherein the light emission unit comprises an anode electrode, and wherein at least one portion of the second metal layer overlapping the anode electrode is opened.

10. The electron emission display of claim 8, wherein the post comprises a plurality of posts arranged between the first and second metal layers.

11. The electron emission display of claim 8, wherein the post is a continuous body formed between the first and second metal layers and is a metal or an alloy.

12. The electron emission display of claim 8 wherein the thermal conduction member further comprises a connecting member adhered to the side member and arranged in parallel to the post.

13. The electron emission display of claim 8, wherein the post maintains a uniform distance between the first and second substrates.

14. The electron emission display of claim 1, wherein the electron emission unit comprises a plurality of cathode electrodes formed on the first substrate, a plurality of gate electrodes crossing the cathode electrodes, an insulating layer interposed between the cathode and gate electrodes, and a plurality of electron emission regions electrically connected to the cathode electrodes.

15. The electron emission display of claim 14 further comprising a focusing electrode formed over the cathode and gate electrodes.

16. The electron emission display of claim 14, wherein the electron emission regions comprise a material selected from the group consisting of carbon nanotubes, graphite, graphite nanofiber, diamond, diamond-like carbon, fullerene ($C_{60}$), silicon nanowire and combinations thereof.

17. The electron emission display of claim 1, wherein the electron emission unit comprises:

a first electrode arranged on the first substrate;

a second electrode arranged on the first substrate apart from the first electrode with a distance therebetween;

a first conductive thin film partially covering the first electrode;

a second conductive thin film partially covering the second electrode; and an electron emission region disposed between the first and second conductive thin films and electrically connected to the first and second electrodes.

18. The electron emission display of claim 17 wherein the first and second conductive thin films comprise a conductive material selected from the group consisting of nickel, gold, platinum, palladium, and combinations thereof.

19. The electron emission display of claim 8, wherein the thermal conduction member is adjacent to the side member, and the thermal conduction member and the side member are within a nonactive area of the electron emission display.

* * * * *